US005283975A

United States Patent [19]

Piterski

[11] Patent Number: 5,283,975

[45] Date of Patent: Feb. 8, 1994

[54] SECURITY WINDOW

[76] Inventor: John P. Piterski, 737 Bayvista Blvd., St. Petersburg, Fla. 33705

[21] Appl. No.: 920,655

[22] Filed: Jul. 28, 1992

[51] Int. Cl.[5] ..... E06B 3/68

[52] U.S. Cl. ..... 49/50; 49/51; 52/507

[58] Field of Search ..... 49/51, 50, 61, 63, 57; 52/507, 656.1, 656.8

[56] References Cited

U.S. PATENT DOCUMENTS

| | | | |
|---|---|---|---|
| 3,340,661 | 9/1967 | Krieger | 49/57 X |
| 4,416,084 | 11/1983 | Zen | 52/207 X |
| 4,679,351 | 7/1987 | Zarlengo et al. | 49/57 |
| 4,702,055 | 10/1987 | Ralph | 52/507 X |
| 5,012,610 | 5/1991 | Carballo | 49/51 X |

*Primary Examiner*—Philip C. Kannan
*Attorney, Agent, or Firm*—David Kiewit

[57] ABSTRACT

A security window guard is permanently installed into pre-existing awning-type windows (also referred to as Miami windows) by first fastening a separate strip inside the window jambs with fasteners that anchor the strip through a jamb to the wall. This strip has an array of holes that incorporate lead-in guides extending from each hole to a free edge of the strip. Subsequently, holes are drilled in the window jambs at locations aligned with a plurality of pins that protrude from the security frame, an array of fixed pins formed on one side of the security frame is inserted into one set of holes, and the security frame is pushed into the window frame. When the security frame is pushed into the window frame the lead-in guides act to compress spring-loaded pins extending from an opposing edge of the security frame. When the security frame is fully inserted in the window frame, the spring loaded pins extend outward into the holes at the ends of the guides, thereby locking the security frame permanently into position.

3 Claims, 1 Drawing Sheet

SECURITY WINDOW

BACKGROUND OF INVENTION

This invention relates to an apparatus and method of preventing the entrance of unauthorized persons through a window of a dwelling, or other structure.

It has been customary to provide the installation of an array of steel bars onto the outside or inside, of the windows of a dwelling, or other structure, thereby presenting an obstacle to an intruder. These steel bars are installed, and are held or locked into place, and do provide a certain amount of protection from intruders. There is a set of problems associated with these types of intrusion protection methods, in that, if the bars are permanently installed in the dwelling or, other structure, and an emergency exists, such as a fire inside the dwelling, the occupants find themselves locked in their own home, or, other dwelling, and cannot escape through the windows.

Several approaches have been provided for solving this problem, some with a certain amount of success. Young, in U.S. Pat. No. 4,070,048 teaches a releaseable window guard, which will release the Steel Bars in case of emergency. There is a problem with this method, as the intruder need only break the window, and release the Steel Bars themselves, thereby sabotaging the intrusion protection.

Another approach is taught by Smith, in U.S. Pat. No. 3,918,202, wherein a decorative system of steel bars is attached inside a wooden window, locked into place, and becomes a part of the decor of the window, or, the building. Here again, the problem exists in these teachings, that the intruder need only break the window glass, release the bars themselves, and enter the premises.

Still another approach is taught in the art of Bennett, in U.S. Pat. No. 4,848,030, wherein a matrix of steel bars are installed into the Window Frame, and locked into place. Here again, the lock is necessarily in a location which is available to the intruder, thereby sabotaging the security method.

SUMMARY OF THE INVENTION

Accordingly, it is an object of this invention to provide a new and improved method, and apparatus, to present an obstacle to intruders trying to enter a window, and to provide this method and apparatus with an emergency release device, not within the reach of an intruder.

Another object of this invention is to provide a new and improved method and apparatus to present an obstacle to intruders trying to enter a window, and to provide this apparatus as a permanently installed matrix, of a material strong enough to cause great difficulty to an intruder.

Another object of this invention is to provide this apparatus to be mounted in an aluminum awning type window, also referred to as "Miami" type window, Miami type windows being known in the industry.

Still another object of this invention is to provide this apparatus in a design as to allow a storm window to be mounted inside the inner periphery of the window.

Yet another object of this invention is to provide this method and apparatus in a simple design to allow for easy installation onto, or, into, existing windows with very little retro-fitting.

In carrying out this invention in the illustrative embodiment thereof, an aluminum awning type window, having two separate outwardly rotating window vents, with the window panes being controlled by the normal turning handle from the inside of the room, is fitted with a narrow strip of material at the bottom window jamb by a series of nails driven through pre-drilled holes in the narrow strip of material, through the window jamb itself, and down into the framework of the window framing. This narrow strip of material has been pre-drilled with holes spaced to accept a series of spring loaded pins located on the bottom underside of a metal framework, the framework having a matrix of metal vertical and horizontal cross pieces firmly attached within the framework, thereby creating an intrusion obstacle for the window. The framework has a series of permanent pins extending upwardly from the top of the framework, and these two permanent pins fit into two pre-drilled holes in the top of the window jamb. The metal framework is fitted into the window jamb at the top, and the series of pins of the metal framework fitting into the pre-drilled holes in the top of the window jamb. The bottom of the metal framework, having a series of spring loaded pins, is slid inwardly into the window jamb, using lead-in guides in the narrow strip of material, which has been fastened to the bottom of the window jamb.

The series of spring loaded pins on the bottom underside of the metal framework are compressed, allowing the metal framework to be slid into the window jamb, and, when the series of pins engage the series of pre-drilled holes in the bottom of the window jamb, the four pins fall into place, thereby permanently holding the metal framework in place inside the comfines of the window jamb, and thereby forming an intrusion protection for the window.

BRIEF DESCRIPTION OF THE DRAWINGS

This invention, together with other objects, features, aspects and advantages thereof, will be more clearly understood from the following description, considered in conjunction with the accompanying drawings.

DESCRIPTION OF THE PREFERRED EMBODIMENTS

Figure 1:
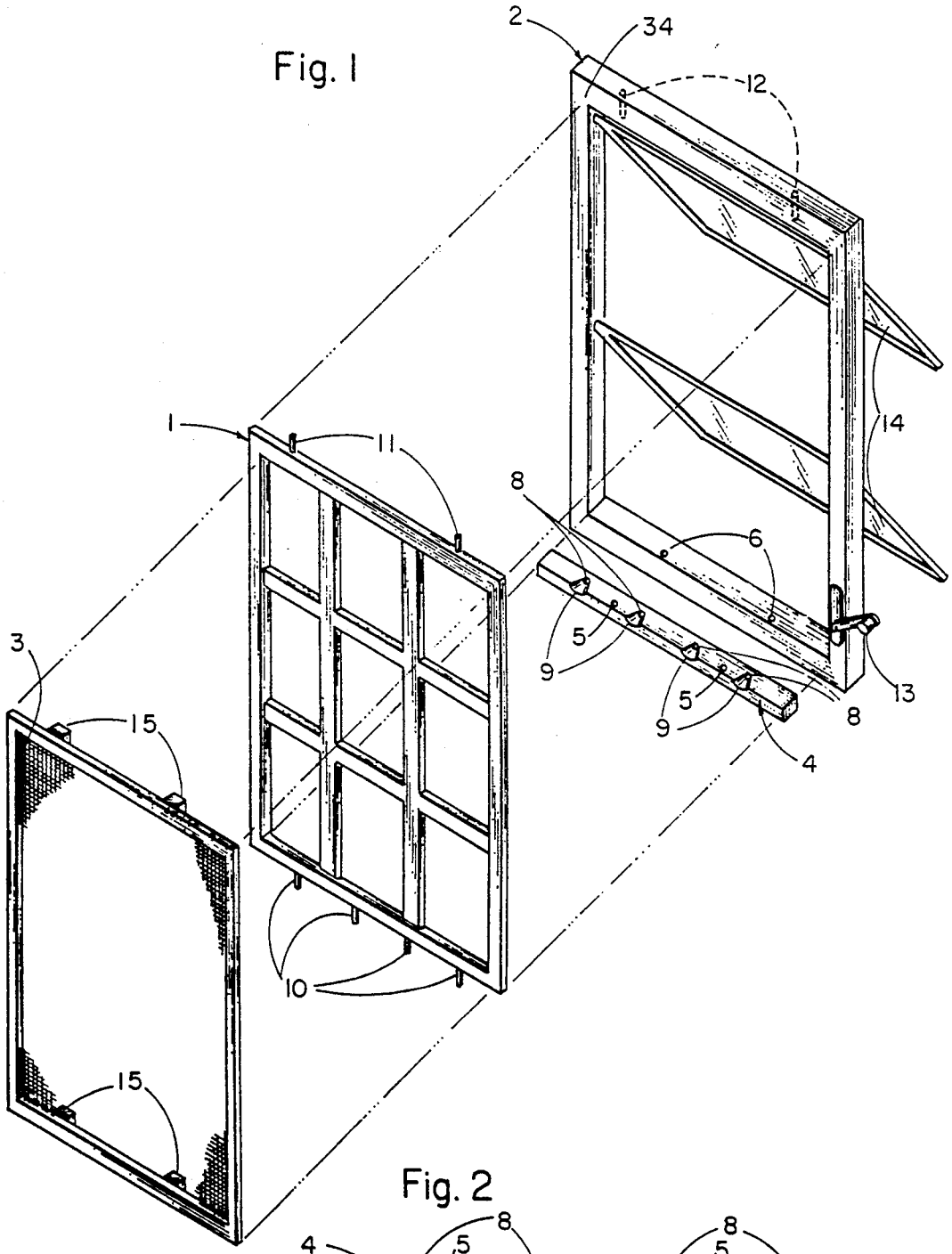
FIG. 1 is an exploded view of the invention, showing the Miami type window, the metal framework, and the screen insert.

Referring now to FIG. 1, a security window guard having emergency release feature, is made of a suitable material to create a metal framework 1 and this metal framework 1 is an obstacle to an intruder having two locking pins 11 pre-installed in the top portion of the metal framework 1, and several spring loaded locking pins 10 pre-installed in the bottom of metal framework 1.

Figure 2:
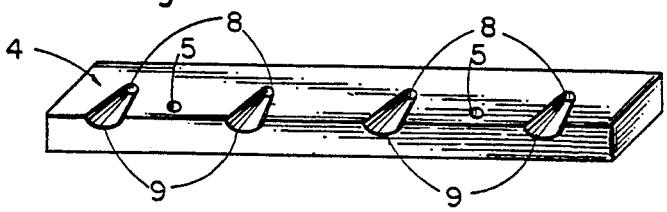
FIG. 2 is an isometric view of the narrow strip of material with the guides for inserting the metal framework.

A narrow, pre-drilled strip of material 4 having the shape of a rectangular parallelpiped is nailed onto the bottom jamb 34, of an aluminum awning type window 2, using pre-drilled, and pre-positioned holes 5, and accepting holes 6. This narrow strip of material 4, more easily seen in FIG. 2, fills a gap at the bottom of a Miami window jamb 34, and also having lead-in guides 9 that are cut into the top and outward facing surfaces of the strip 4 and that provide a sloping surface to guide spring loaded pins 10 into pre-drilled holes 8 after top pins 11 have been inserted into accepting holes 12 in jamb 34, thereby permanently locking metal framework 1 into Miami window 2. Although frame 1 has been permanently installed into Miami window 2 by affixing pins 10, 11 the Miami type window 2 can still be operated to the open position by means of handle 13, thereby opening panes 14.

Now, and still referring to FIG. 1, an insect screen, 3 is inserted into the security window guard 2, and is held in place by magnets 15, thereby converting an aluminum awning type window, to an intrusion secure window.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. Security apparatus installable within a frame of an awning-type window, said window including a first plurality of holes in a top jamb thereof, said apparatus comprising:

a generally rectangular framework comprising a top, a bottom, and two sides, each said side a predetermined length shorter than a side jamb of said window, said framework including a plurality of rigid pins extending from said top, each said rigid pin located in alignment respectively with one of said first plurality of holes, said framework further including a plurality of spring-biased pins depending from and biased outward from said bottom, and a strip, shaped generally as a rectangular parallelpiped having a height slightly less than said predetermined length and having a second and a third plurality of holes extending therethrough, said strip affixable to a bottom jamb of said window by a plurality of fasteners, each said fastener insertable respectively through one of said second plurality of holes, said third plurality of holes spaced in alignment with ones of said plurality of spring-biased pins, whereby said security apparatus is affixable within said window frame by inserting said plurality of rigid pins into said first plurality of holes, raising said spring-biased pins, and pushing said framework into said frame of said window whereupon said spring-biased pins extend under the bias of said springs into said third plurality of holes.

2. A security apparatus of claim 1 wherein a said hole of said third plurality of holes comprises a lead-in guide extending from a circumference of said a said hole to an outward facing surface of said strip.

3. A security apparatus of claim 1 wherein said top, said bottom and said sides of said framework are formed from metal tubes, and wherein said framework further comprises a plurality of metal cross-members.

* * * * *